United States Patent [19]

McIntire

[11] Patent Number: 4,513,460

[45] Date of Patent: Apr. 30, 1985

[54] SOFA SLEEPER SEAT SUPPORT SYSTEM

[75] Inventor: Darrell L. McIntire, St. Louis, Mo.

[73] Assignee: Leggett & Platt, Incorporated, Carthage, Mo.

[21] Appl. No.: 487,175

[22] Filed: Apr. 21, 1983

[51] Int. Cl.[3] ..... A47C 17/04

[52] U.S. Cl. ..... 5/13; 5/29

[58] Field of Search ..... 5/13, 28–36, 5/233, 51 D

[56] References Cited

U.S. PATENT DOCUMENTS

| | | | |
|---|---|---|---|
| 2,352,989 | 7/1944 | Woller | 5/13 |
| 2,878,490 | 3/1959 | Schneider | 5/13 |
| 2,985,893 | 5/1961 | Trossman | 5/13 |
| 3,247,526 | 4/1966 | Rogers | 5/13 |
| 3,854,153 | 12/1974 | Fadler et al. | 5/13 |
| 4,104,745 | 8/1978 | Pacitti | 5/29 |
| 4,173,803 | 11/1979 | Kennedy | 5/13 |
| 4,253,205 | 3/1981 | Mikos | 5/29 |

*Primary Examiner*—Alexander Grosz
*Assistant Examiner*—Vinh Luong
*Attorney, Agent, or Firm*—Wood, Herron & Evans

[57] ABSTRACT

A sofa sleeper having an improved seating surface wherein the seating surface is rigidified by having a cross brace attached between the foldable legs of the sofa sleeper fixture to move up beneath the underside of the folded matress of the sofa sleeper and push that underside upwardly to prevent sagging of the seat when a person is seated upon the seat of the folded sofa sleeper.

4 Claims, 3 Drawing Figures

SOFA SLEEPER SEAT SUPPORT SYSTEM

BACKGROUND OF THE INVENTION

This invention relates to an improved seat cushion support for use in a combination sofa sleeper having a foldable bed frame adapted to be collapsed and hidden in the bottom of a sofa frame.

Foldable sofa sleepers having pivotally interconnected head, body, intermediate, and foot sections movable between a fully folded or retracted position within the sofa frame and an extended position wherein the sections extend out and over the front rail of the sofa frame are known to the art. In such foldable sofa sleepers, in the extended position, the head, body, intermediate, and foot sections lie substantially coplanar one to the other providing a horizontal surface upon which a mattress is placed to provide a bed. In the folded sitting position of said foldable sofa sleepers, the body and foot sections of the sofa frames are located in parallel spaced horizontal planes interconnected by the substantially vertically poisitioned intermediate frame section. The bed mattress is folded substantially double between the foot and body sections of the frame in this folded position and the foldable frame and mattress are contoured and hidden within the sofa frame. Generally, cushions cover or are placed atop the folded mattress in this seating position of the sofa sleeper.

One criticism which has fairly been leveled against most convertible sofa sleepers is that they do not provide as comfortable a seating surface as a conventional non-convertible sofa. In general, this criticism is traceable to the fact that the cushion support, the folded mattress contained internally of the folded sofa sleeper tends to sag when a substantial weight is placed upon it. This "sag" results from the fact that the mattress supporting deck must be resilient or at least have some resiliency in order to provide a satisfactory sleeping surface, and this resiliency carries over to the seating position of the sofa sleeper wherein the resiliency is to be avoided in order to provide maximum comfort in the seating position.

One attempt to solve this problem of seat sag in the seating attitude of the sofa sleeper has been to stretch the matteess supporting canvas or fabric deck beneath the folded mattress when the sofa sleeper is folded into the sofa frame, thereby providing a taut support beneath the sofa cushions. Such an attempt for improving the seating surface of a sofa sleeper is disclosed and described in U.S. Pat. Nos. 2,352,989, 2,878,490, and 4,173,803.

Yet another attempt to solve this same problem is disclosed in U.S. Pat. No. 3,854,153. According to the disclosure of this patent, crossed tension wires are located beneath the intermediate section of the bed frame in an attempt to rigidify the support beneath the mattress when it is folded into the sofa frame and serves as a support for the seat cushions.

Up to the present time the solutions or partial solutions described in the patents identified hereinabove have substantially improved the seating characteristics of a convertible sofa sleeper. However, even with these improvements, the seating surfaces do not measure up to and are not as comfortable a seating surface as a non-convertible type sofa.

It has therefore been an objective of this invention to provide a sofa sleeper having a seating surface which is more comfortable than that heretofore provided in convertible sofa sleepers.

Still another objective of this invention has been to provide a more rigid and firm mattress support for a sofa sleeper when the mattress is folded into the sofa frame and functions as a support for seat cushions without detracting from the resiliency and comfort of the mattress support in the extended coplanar position of the mattress support.

SUMMARY OF THE INVENTION

These objectives are achieved and this invention is predicated upon the concept of providing a seat support system in the form of a cross brace interconnecting the foldable legs of a foldable sofa sleeper mechanism. In a preferred embodiment of the invention, this cross brace is in the form of bowed tubes extending between the foldable legs of a bed frame. Commonly, sofa sleeper mechanisms are provided with legs which extend downwardly from the body and foot sections of the bed frame for supporting those sections above floor level when the sofa sleeper is unfolded into an extended coplanar bed or sleeping position. When the bed frame is folded into the sofa frame, these legs commonly fold up automatically beneath the bed frame sections. Quite commonly these legs, which are arranged in pairs, are interconnected by a strut or cross member brace. According to the practice of this invention, this cross member brace is located near the ground contact end of the foldable legs and is bowed so that when folded beneath the bed frame, it contacts and pushes upwardly against the bottom of the folded mattress supporting deck so as to provide additional support for the folded mattress. This bowed seat support cross member or brace actually contacts and pushes the bottom of the folded mattress upwardly, thereby rigidifying and adding to the firmness of the cushion seat support of the sofa sleeper.

The primary advantage of this invention is that it provides an improved seating surface for a convertible sofa sleeper without appreciably adding to the cost of the sofa sleeper. Traditionally, a cross brace has always interconnected the foldable legs of a sofa sleeper mechanism but this cross brace has never served as a mattress support. In the past it functioned only to interconnect and rigidify the foldable legs of the mechanism when the bed frame was unfolded into the flat sleeping attitude. With this invention the firmness and comfort of the seating surface are substantially improved without adding any appreciable cost to the sofa sleeper product.

These and other objects and advantages of this invention will be more readily apparent from the following description of the drawings, in which.

Figure 1:
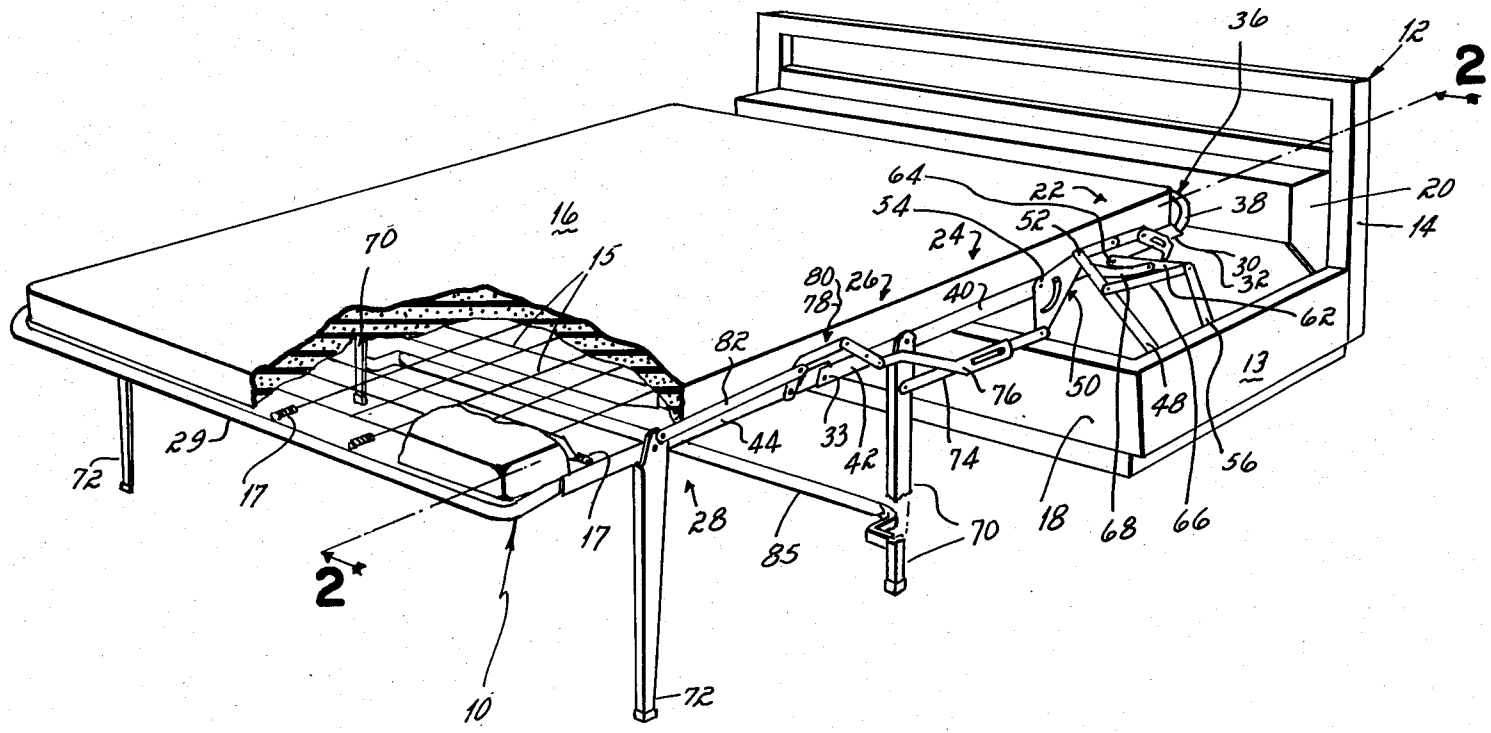
FIG. 1 is a perspective view of a foldable sofa sleeper embodying the invention of this application, the sofa sleeper being shown in the extended bed position.

Referring now to the drawings and particularly to FIG. 1, a foldable sofa sleeper bed frame 10 is illustrated as being mounted upon a wooden frame 12 of an upholstered sofa which has a back 14, a fixed front rail 18, and a pair of side rails 13 extending between the back 14 and front rail 18 which define a generally rectangular storage enclosure 20 for the folded bed frame 10. The sofa itself does not form any part of the present invention and may comprise any well known standard upholstered frame construction. As used herein, the terms "front" or "forward" end of the bed reference that direction which is away from the wooden frame 12 while the terms "rear" and "rearward" refer to a direction which is toward that frame 12.

The details of the foldable sofa sleeper bed frame 10 other than the foldable legs for supporting the extended or unfolded bed frame and a cross brace extending between the foldable legs are not critical to this invention. A presently preferred sofa sleeper bed frame is shown in my U.S. Pat. No. 4,253,205, the disclosure of which is incorporated by reference. Those skilled in the art are referred to this patent for the details of the foldable bed frame construction.

In general, however, the foldable sofa sleeper bed frame 10 comprises a rear head section 22, a long intermediate or main body supporting section 24 pivotally connected at one end to the head section 22, a short intermediate section 26 pivotally connected at one end to the other end of the main body section 24, and a front foot section 28 pivotally connected to the other end of the short intermediate section 26. The head section 22 comprises similar symmetrically disposed left and right main angles 30 (only the right angle being shown in FIG. 1). As is conventional in the industry, the angles making up the frame have an outer vertical flange extending up from an outer edge of a lower inwardly extending flange. The rearward ends 32 of the side angles 30 of the head section 22 are interconnected by cross member 36 which comprises a transverse tubular member bent at its ends to form arms 38 which are riveted to adjacent ends 32 of the main angle 30.

The long intermediate or main body section 24, the short intermediate section 26, and the foot section 28 each comprise similar, symmetrically disposed left and right main angles 40, 42 and 44, respectively (only the right being shown). As stated, the details of these sections form no part of the present invention and are described herein merely for purposes of illustrating a particularly useful environment of the present invention. The interconnected sections 22, 24, 26 and 28 together form a rectangular frame when the bed frame 10 is fully pulled out. As may be seen in FIG. 1, the sections lie in coplanar relation, i.e., they all lie in the same horizontal plane, and provide a rectangular frame for supporting resilient planar deck 15 for supporting a mattress 16 in a bed extended or "sleeping" position. The deck 15 which may be an all link wire fabric or an all cloth deck or a combination wire link fabric and cloth deck, is conventionally connected to the bed frame 10 by helical springs 17 so as to provide a resilient supporting surface for the mattress 16.

The foldable frames on both sides of the bed making up the interconnected sections 24, 26 and 28 are similar and are symmetrically disposed. Since the means which connect the longitudinal portions of the bed on the right and left facing sides of the bed are similar and symmetrically disposed only the connections on one side are shown in the drawings. The side of the frame shown in FIG. 1 is the right facing side of the bed which is the side on the right side of a person standing in front of the foot of the bed and looking toward the head end of the bed.

Figure 2:
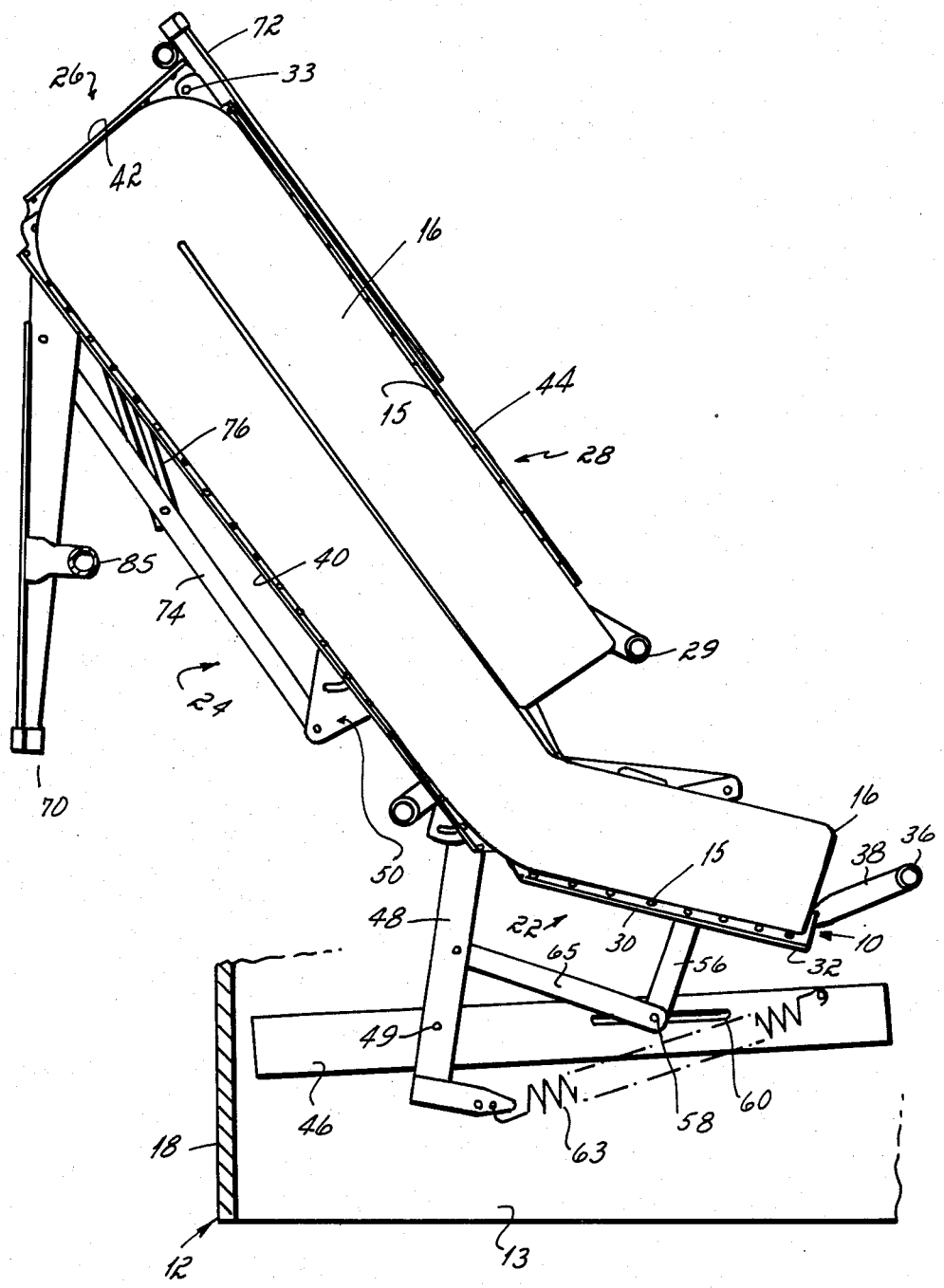
FIG. 2 is a side elevational view of the sofa sleeper as seen on line 2—2 of FIG. 1, but illustrating the bed frame in a partially folded attitude.

As best seen in FIGS. 1 and 2, the foldable bed frame 10 is mounted and supported at its forward end with respect to the wooden frame 12 by an anchor plate 46 secured to the side rail 13 of the wooden frame 12 by suitable means such as bolts or screws (not shown). A front support lever 48 is pivotally connected at its base 49 to the anchor plate 46, and its upper end is pivotally connected to one arm of a bed lock plate 50 by a single rivet 52. The bed lock plate 50 is in turn pivotally connected to the main body section angle 40 by a single rivet 54. A rear support lever 56 has a pin 58 in its base making a sliding and pivoting connection with a slot 60 in the anchor plate 46. The upper end of the rear support lever 56 is pivotally connected to one end of an upper rear support level 62, and the opposite end of the upper rear support lever 62 is pivotally connected to the forwardmost end of the main body section angle 40 by means of a pivot pin 64 interconnecting the main body section angle 40 and the head section angle 30.

The front support lever 48 and rear support lever assembly 56, 62 serve to lift the main body section angle 40 out of the enclosure 20 of the sofa 12 and to project it and the sections articulated to it forwardly over the front rail 18. In the fully extended position shown in FIG. 1, the rear or head end of the main body section angle 40 is supported by these levers. A coil tension spring 63 is fixed at its rearward end to the anchor plate by a pin protruding from the anchor plate and at its forward end passes through a hole in an arm riveted to the front support lever 48 at a point below the fixed pivot 49. The spring biases the front support lever 48 to rotate about the pivot 49 which assists in opening the sofa sleeper unit and holds the frame in a partially open counter-balanced position. A guide link 65 pivotally connected to the pin 58 and to the front support lever 48 controls the movement of these levers on sliding of the pin 58 in the slot 60.

The upper end of the rear support lever 56 is connected to the front support lever 48 by a control link 66 which is pivotally connected at its forward end to the front support lever 48 and at its rearward end to the rear support lever 56 and the upper rear support lever 62. An actuating arm 68 interconnects the upper rear support lever 62, the front support lever 48, and the bed lock plate 50.

The remaining linkages are interconnected for lowering and raising a center leg 70 and front leg 72 supporting the main body section 24, short intermediate section 26, and foot section 28. These linkages include a center leg actuating arm 74 for actuating the center leg 70 and a compression arm 76 connected through a bellcrank 78 and bellcrank actuating arm 80 to a front leg actuating arm 82 for actuating the front leg 72. The main body section 24, short intermediate section 26, and foot section 28 are all supported by the center leg 70 and front leg 72 in the bed open or horizontal position with the rear 56, 62 and front support levers 48, respectively, supporting the main body section 24 at its rearward end.

The mechanism for raising and lowering the center legs 70 and front legs 72 is conventional and completely illustrated and described in the above identified U.S. Pat. No. 4,253,205.

Figure 3:
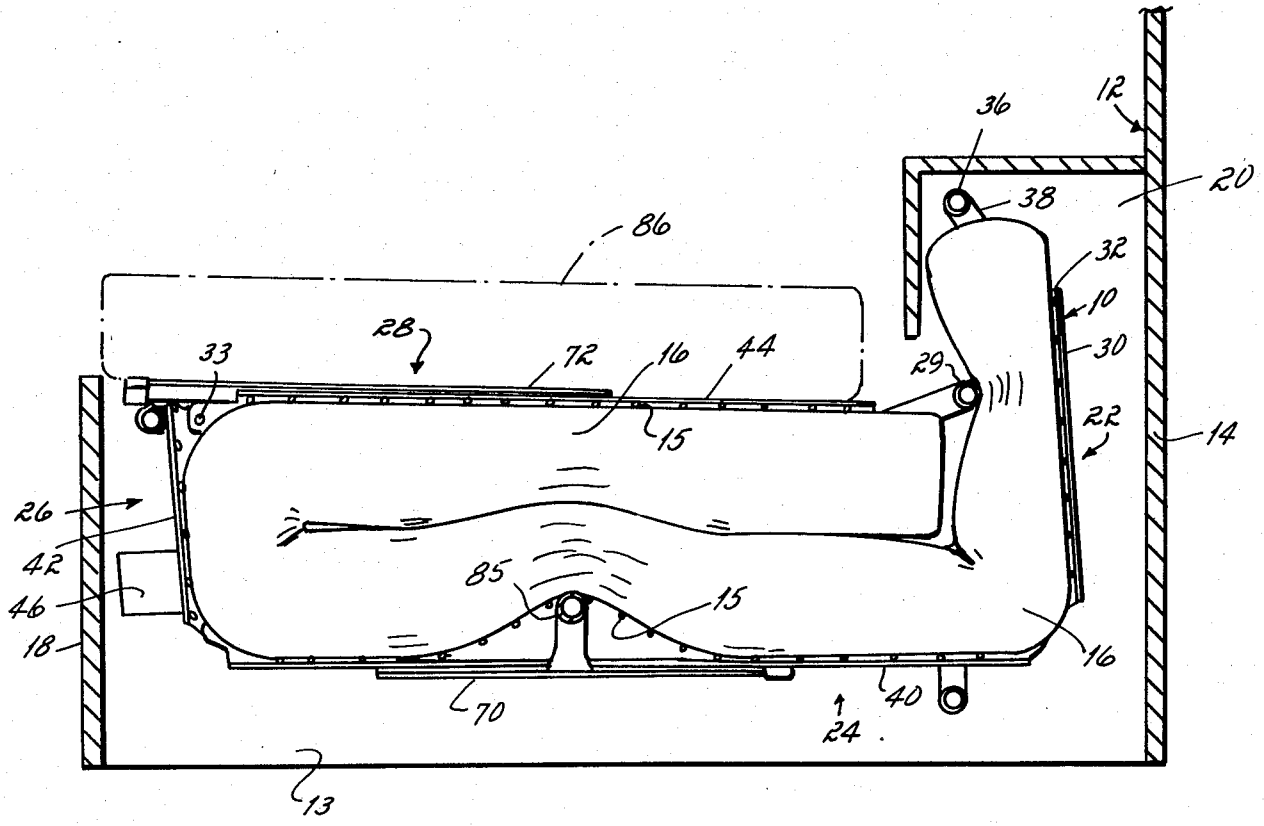
FIG. 3 is a side elevational view of the sofa sleeper similar to FIG. 2 but illustrating the bed frame in a completely folded attitude.

The folding sequence in which the bed frame 10 converts from a bed as illustrated in FIG. 1 to a sofa is illustrated in FIGS. 2 and 3. In the FIGS. 2 and 3, it will be seen that the first step in the folding of the bed is to lift the front tubular cross member 29 until the foot section of the frame is located in a position just past a vertical plane. As a consequence of this movement, the front leg 72 is caused by the actuating mechanism to fold against the foot section 28 of the bed frame.

Continued pushing against the cross member 29 causes the frame 28 to pivot about the pivot point 33 connecting the intermediate and body section 26 to the frame 28, thereby lifting the intermediate section 26 of the frame into vertical position. In the vertical position of the intermediate section 26 of the frame, the forward end of the mattress 16 is completely folded over upon itself to a double thickness as shown in FIG. 2. When the intermediate section 26 of the frame reaches the vertical attitude, the foot section 28 is then located in a parallel plane over the top of the double thickness mattress and body section 24.

Continued folding movement of the frame is then effected by lifting the tubular member 29 upwardly so as to lift what is now the front of the partially folded frame including the center leg 70 upwardly. At the time the operator grasps the member 34 to lift the partially folded bed frame, the front legs have been fully collapsed into engagement with the foot section 28 of the bed frame. The upward movement of the front of the frame causes the center leg actuating arm 74 to be moved rearwardly, completely collapsing the center legs 70 beneath the body section 24 of the frame. The center legs 70 then remain completely collapsed beneath the body section of the frame when the folded frame is completely folded into the sofa frame.

It will be noted that there is a seat supporting cross brace or tube extending transversely between the center legs 70 of the bed frame. The opposite ends of this seat supporting cross brace are riveted or welded to the lower ends of the center legs 70.

The invention of this application is predicated upon the provision of a bow in the seat supporting cross brace 85 and in location of this seat supporting cross brace adjacent the lower ends of the center legs 70. As may be seen most clearly in FIGS. 1 and 3, the bow in the seat support tube is toward the rear or head end of the bed frame. Because of the presence of this bow, when the legs 70 are fully collapsed against the body section 24 of the frame, the bowed portion of the seat supporting cross brace contacts the underside of the mattress supporting deck 15 and pushes that deck 15 upwardly, thereby compressing the double thickness folded mattress sandwiched between the body section 24 and the foot section 28 of the folded bed frame. By pushing upwardly against the underside of the mattress supporting deck, the otherwise taut underside of the mattress supporting fabric or deck 15 is pushed upwardly approximately two inches out of the horizontal plane, and the mattress supported on top of the mattress supporting deck is compressed to approximately this same degree. This location of a rigid seat supporting cross brace beneath the folded mattress and pushing upwardly upon the underside of the folded mattress, has the effect of firming up the cushion supporting seat of the folded sofa sleeper. One of the criticisms of most convertible sofa sleepers is that the seating surface provided by the folded sofa sleeper is not sufficiently rigid, with the result that when a person is seated upon the cushions 86 the cushions tend to sag, particularly in the middle section of the sofa sleeper. The provision of the bowed seat support tube beneath the cushion supporting folded mattress, has the effect of pushing upwardly upon the underside of the folded mattress approximately medially (when considered from front to rear of the sofa sleeper) of the folded mattress. This has a very beneficial effect in improving the seating surface of the folded sofa. Specifically, the bowed seat supporting cross brace rigidifies or firms up that seating surface and makes it much more comfortable than a sofa sleeper which does not include the bowed seat support cross brace 85.

When the sofa sleeper is unfolded or moved from a folded attitude as pictured in FIG. 3 to an extended or sleeping attitude as pictured in FIG. 1, the seat support tube 85 moves from beneath the mattress supporting fabric or deck 15 so that the tube in no way inhibits or interferes with the sleeping comfort of the resiliently supported deck. In the extended position of the sofa sleeper the seat supporting cross brace is completely out of engagement with the mattress supporting fabric deck 15 located a substantial distance from the underside of the mattress supporting deck. No matter how much the deck is deflected by the weight of a person sleeping upon the mattress 16, the underside of the mattress will not contact the seat supporting cross brace, and a person sleeping upon the mattress will not feel that cross brace.

While I have described only a single preferred embodiment of my invention, persons skilled in this art will appreciate numerous changes and modifications which may be made without departing from the spirit of my invention. Therefore, I do not intend to be limited except by the scope of the following appended claims.

I claim:

1. A foldable sofa sleeper bed frame adapted to be mounted upon a sofa frame having back, front and side members which define a generally rectangular storage enclosure, said foldable bed frame comprising a plurality of pivotally interconnected head, body, intermediate and foot sections, said bed frame sections each including a pair of opposed side rails and a mattress supporting deck located between said side rails, and means supporting said bed frame for movement between (1) a retracted folded position in which the bed frame is contained within said storage enclosure, and (2) an extended position in which said bed frame lies above and extends forwardly over said front frame member to form a generally horizontal planar bed, said bed frame when in said extended position being supported by a first pair of foldable legs pivotally connected to the foot bed frame section and a second pair of foldable legs connected to said bed frame intermediate said first pair of foldable legs and said head end of said frame, a foldable mattress mounted atop said mattress deck, and a seat support system for engaging and supporting the underside of said mattress supporting deck when said bed frame is in said retracted folded position contained within said storage enclosure, said seat support system comprising, a cross brace attached to said second pair of legs, said cross brace being bowed between said second pair of foldable legs, the bow of said cross brace being convex substantially upward approximately two inches out of the horizontal plane when said bed frame is in a retracted folded position to form a sofa seat so that said cross brace is engageable with the underside of said mattress supporting deck to force said mattress supporting deck upwardly when said bed frame is in said retracted folded position.

2. The sofa sleeper bed frame of claim 1 wherein said body section of said deck is located in a generally horizontal plane when said fixture is folded to form a sofa seat, said cross brace being operable to engage and force a portion of said body supporting section of said deck upwardly out of said generally horizontal plane when said bed frame is folded to form a sofa seat.

3. The sofa sleeper bed frame of claim 2 wherein said mattress is folded double between said foot and body sections of said deck when said bed frame is folded to form a sofa bed, said cross brace being operable to push and deflect the underside of said double folded mattress upwardly when said bed frame is folded to form a sofa seat.

4. A folded sofa bed fixture adapted to be mounted upon a sofa frame, said fixture comprising, a plurality of pivotally interconnected head, body, intermediate and foot bed frame sections, each of said bed frame sections including a pair of opposed side rails and a mattress supporting deck located between said side rails, said bed frame being extendable to form a bed and foldable to form a sofa seat, said bed frame being supported by a pair of foldable legs intermediate the head end and foot end of said bed frame when extended to form a bed, a foldable mattress supported on top of said mattress supporting deck, and a seat support system including a cross brace extending between said pair of foldable legs, said cross brace being generally bowed between said pair of foldable legs, said cross brace being bowed generally convex substantially upward approximately two inches out of the horizontal plane when said fixture is folded to form a sofa seat, and said cross brace being engageable with the underside of said body section of said deck when said fixture is folded to form a sofa seat, and being movable out of engagement with said body section of said deck when said fixture is extended to form a bed, said cross brace when engaged with said body section of said deck being operable to force said underside of said deck upwardly out of a generally horizontal plane so as to reinforce and rigidify the seating surface of said sofa sleeper by forcing the mattress supported by said body section of said deck upwardly into a compressed condition.

* * * * *